US006073675A

United States Patent [19]

Dannaher

[11] Patent Number: 6,073,675

[45] Date of Patent: Jun. 13, 2000

[54] SELF INSTALLABLE AND SIMPLY REMOVABLE WINDOW SCREEN

[76] Inventor: Thomas F. Dannaher, 43 Sheldon St., Billerica, Mass. 01862

[21] Appl. No.: 09/277,086

[22] Filed: Mar. 26, 1999

[51] Int. Cl.[7] ..... A47H 3/00

[52] U.S. Cl. ..... 160/369; 160/368.1; 160/354; 160/DIG. 16; 24/303; 49/463

[58] Field of Search ..... 160/129, 354, 160/368.1, 369, DIG. 2, DIG. 12, DIG. 16, 370.22; 24/303; 49/463; 52/202

[56] References Cited

U.S. PATENT DOCUMENTS

| | | | |
|---|---|---|---|
| 2,595,833 | 5/1952 | Flaherty . | |
| 2,639,751 | 5/1953 | Flaherty | 160/DIG. 16 X |
| 2,717,036 | 9/1955 | Harris | 160/DIG. 16 X |
| 3,000,016 | 9/1961 | Ridge | 24/303 |
| 3,016,952 | 1/1962 | Shero . | |
| 3,679,505 | 7/1972 | Hinderaker et al. . | |
| 3,805,872 | 4/1974 | Lorber . | |
| 4,409,758 | 10/1983 | Dickerson et al. . | |
| 4,419,982 | 12/1983 | Eckels | 160/368.1 X |
| 4,802,523 | 2/1989 | Scholten et al. | 160/368.1 X |
| 4,972,896 | 11/1990 | Roberts . | |
| 5,090,469 | 2/1992 | Boulanger | 160/368.1 |
| 5,097,886 | 3/1992 | Moyet-Ortiz | 160/368.1 |
| 5,983,464 | 11/1999 | Bauer | 24/303 |
| 5,992,498 | 11/1999 | Boston | 160/368.1 X |

*Primary Examiner*—Daniel P. Stodola
*Assistant Examiner*—Bruce A. Lev
*Attorney, Agent, or Firm*—Morse, Altman & Martin

[57] ABSTRACT

A window screen attachment apparatus and method for attaching a screen to a window frame. The apparatus includes a mesh screen with a rigid frame, a number of ferromagnetic cups and mating permanent magnets, and a gasket. Each cup is permanently attached to the screen frame at the surface or in a recess, and includes a depression with a flat floor and a perpendicular wall. The magnet is shaped to fit relatively snuggly into the depression. The cup is either a single piece of ferromagnetic material, separate floor and wall components, or a single floor component and a wall that is the sides of a recess in the screen frame. The magnets are attached to the window frame by an adhesive that is initially protected by a release layer. The gasket is a set of compressible strips that provides a barrier items passing through the gap between the window and screen frames. The window screen is attached by placing the magnets in the cups, removing the release layer, and pressing the adhesive against the window frame. The screen is removed by pulling the screen away from the magnets.

16 Claims, 3 Drawing Sheets

SELF INSTALLABLE AND SIMPLY REMOVABLE WINDOW SCREEN

BACKGROUND OF THE INVENTION

1. Field of the Invention

The present invention relates to window screens, more particularly, to a new apparatus and method of removably affixing screens to pre-existing windows.

2. The Prior Art

A screen is used in conjunction with a window so that when the window is opened, relatively large airborne items, such as insects and leaves, cannot enter. Many older and some newer buildings have only windows and are not designed to accept screens. There are a number of solutions to this problem disclosed in the prior art. Roberts (U.S. Pat. No. 4,972,896) provides an elongated snap-in device for removably securing a screen to a window frame. There are also several disclosures of devices that depend upon magnetic attraction to affix the screen or other covering to the window frame. Included in this group are Hinderaker et al. (U.S. Pat. No. 3,679,505) and Dickerson et al. (U.S. Pat. No. 4,409,758), which rely upon a magnetic strip on the window covering (Hinderaker et al.) or window frame (Dickerson et al.) to secure the window covering.

One disadvantage to these disclosures is that they rely upon the attachment device to provide a barrier between the window frame and the window covering. To this end, their attachment devices extend around the entire the periphery of the window, or as much of the periphery necessary to provide a barrier.

A second disadvantage is that, because they use straight, elongated attachment devices, they cannot be used with windows having rounded sides particularly easily. To accommodate round sides, short lengths of the attachment device must be used and abutted at odd angles.

SUMMARY OF THE INVENTION

An object of the present invention is to provide an apparatus and method for removably attaching a window screen that is easy to install.

Another object is to a provide a screen attachment apparatus that can be used with any shape of screen.

A further object is to provide a screen attachment apparatus that is self-aligning when the screen is being reinstalled.

The window screen attachment apparatus of the present invention provides a means for attaching a screen to a window that does not have an integral means to do so. The basic attachment apparatus includes a screen, a number of cups and mating magnets, and a gasket. The typical screen is a mesh sheet with a rigid frame.

Each cup has a flat surface by which it is permanently attached to the screen frame, either on the surface of the frame or embedded within a recess in the frame, by any means of permanent attachment available. The cup includes a depression opposite the flat surface. The depression has a flat ferromagnetic floor and a perpendicular wall that extends around the entire circumference of the floor. The magnet is a typical permanent magnet that is shaped to fit relatively snuggly into the depression. The outline of the depression/magnet may be any shape desired and different depression/magnets may be different shapes so that the screen can be installed in only one orientation.

The cups are preferably located at the corners of the screen frame, but if a more secure attachment is needed, more cup/magnet combinations can be used. For round or oval windows, it is preferred that the cups be spaced evenly around the screen frame.

There are three preferred embodiments of the cup. In the first, the cup is a single piece of ferromagnetic material. In the second, floor and wall are separate components that form the cup when attached to the screen frame. In the third, the floor is single component and the wall is formed by the sides of a recess in the screen frame.

The magnets are attached to the window frame by an adhesive layer. A release layer protects the adhesive prior to attachment to the window frame.

The gasket provides a barrier to prevent items from entering the window between the window and screen frames. The preferred gasket is preferably a series of easily compressible strips adhered to the screen frame and extending between all of the adjacent pairs of cups. Preferably the gasket is thicker than the gap between the window and screen frames so that the gasket is compressed to make sure the barrier is in place.

The window screen is attached by placing the magnets in their respective cups, removing the release layer from the magnets, and pressing the adhesive layer of the magnets against the window frame. The screen is removed by pulling the screen away from the magnets. It is easily reinstalled by positioning the cups over the magnets and letting the magnets pull the cups into contact.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION

Figure 1:
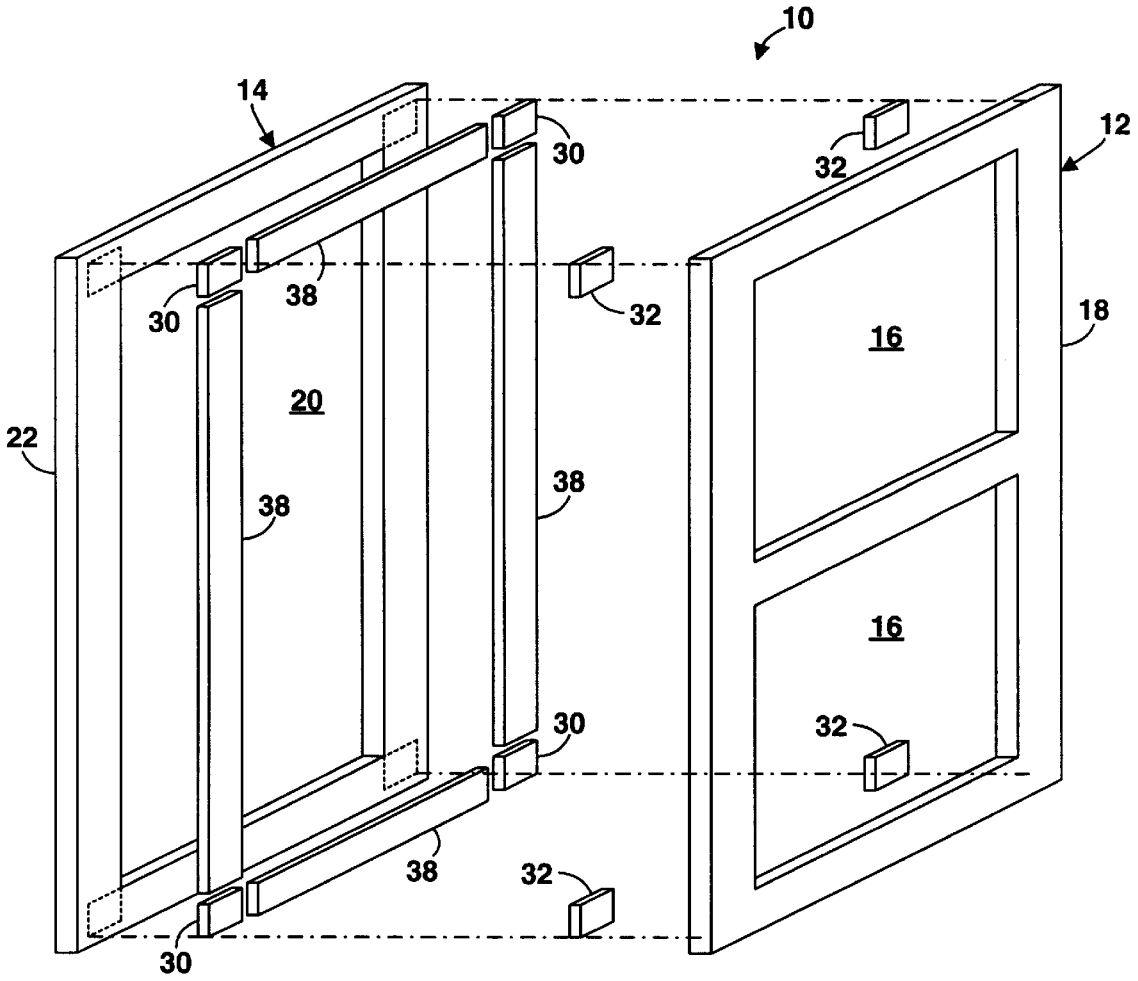
FIG. 1 is an exploded, perspective view of the present invention.

The window screen attachment apparatus of the present invention provides a means for attaching a screen 14 to a window 12 that does not have an integral means to attach a screen 14. The basic attachment apparatus 10 includes a plurality of cups 30, a mating set of magnets 32, a means 34 to attach the cups 30 to the screen 14, a means 36 to attach the magnets 32 to the window frame 18, and a gasket 38 between the screen frame 22 and window frame 18.

The typical window 12 with which the present invention is used includes one or more window panes 16 and a window, frame 18. Unlike many of the attachment devices of the prior art, the window 12 may have any shape, such as rectangular or circular. The frame material must be one that the magnets 32 can be adhered to, as described below. Typical frame materials include wood, aluminum, and/or plastic.

The screen 14 is a typical window screen with a mesh sheet 20 encircled by a rigid screen frame 22. The cups 30 are permanently attached to the screen frame 22, as described below.

The cup 30 has a flat outer surface 40 and a depression 42 opposite the flat surface 40. Preferably, the depression 42 has a relatively flat floor 44 and a wall 46 that is substantially perpendicular to the floor 44. The outline and depth of the depression 42 substantially matches that of the operational face 48 and sides 50 of the magnet 32 with which it mates so that the magnet 32 fits relatively snuggly into the depression 42 and that there is not an undo amount of "play" between the magnet 32 and the wall 46 of the depression 42. The outline may be any shape desired, such as rectangular or circular. It is also contemplated that the depression/magnet combinations of a window be of different contours (shapes and/or sizes) so that the screen 14 can only be installed in one orientation.

Figure 4:
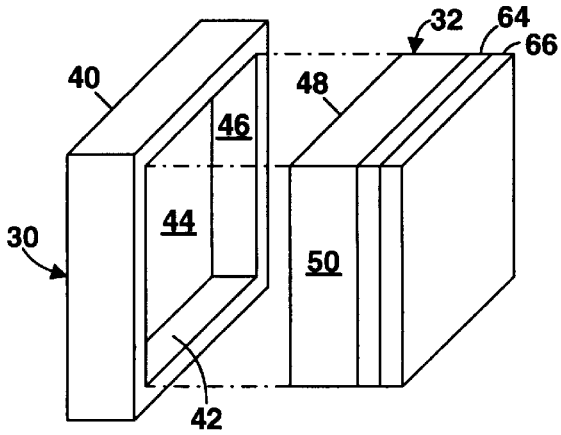
FIG. 4 is a perspective, exploded view of the cup/magnet combination showing the one configuration of the cup.
Figure 5:
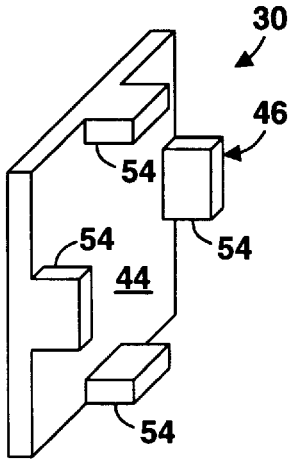
FIG. 5 is a perspective view of another cup configuration.
Figure 6:
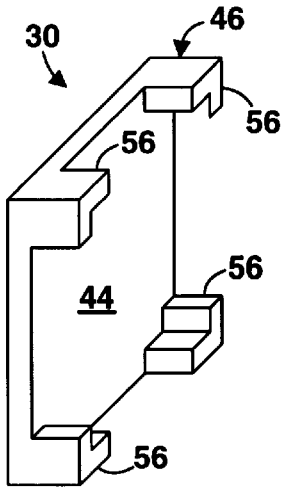
FIG. 6 is a perspective view of another cup configuration.

Preferably, the wall 46 is extends around enough of the floor 44 to substantially prevent the magnet 32 from moving laterally on the floor 44. All possible configurations are contemplated, and several examples are show in FIGS. 4–6. In FIG. 4, the wall 46 extends completely around the floor 44. In FIG. 5, the wall 46 consists of short lengths 54 separated by 90° around the floor 44 to prevent the magnet 32 from moving laterally. In FIG. 6, the wall consists of four corners 56.

Figure 2:
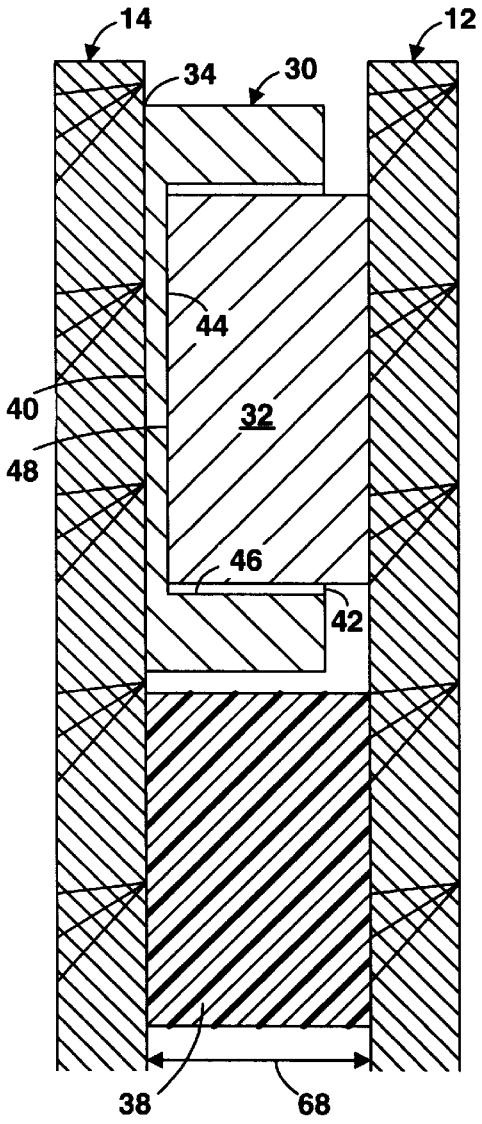
FIG. 2 is a partial side cross-sectional view of the present invention in use.
Figure 3:
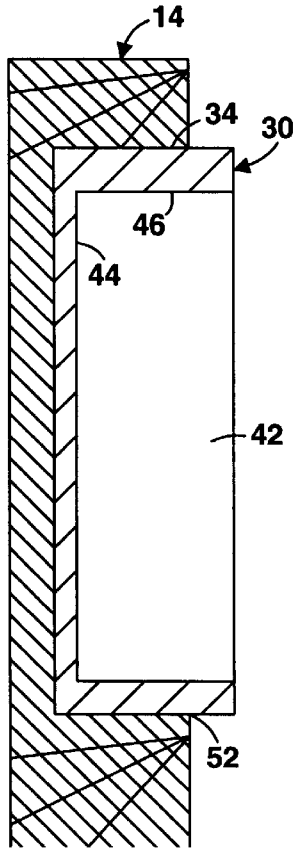
FIG. 3 is a partial side cross-sectional view of the cup embedded in the screen frame.

The cup 30 is permanently attached to the screen frame 22, either on the surface of the frame 22, as in FIG. 2, or embedded within a recess 52 in the frame 22, as in FIG. 3. Any means of permanent attachment 34 is contemplated by the present invention, and the means 34 used is generally determined by the material of which the screen frame 22 is composed. Typical attachment methods 34 include adhesive, screws, nails, staples, rivets, or combinations thereof.

Figure 7:
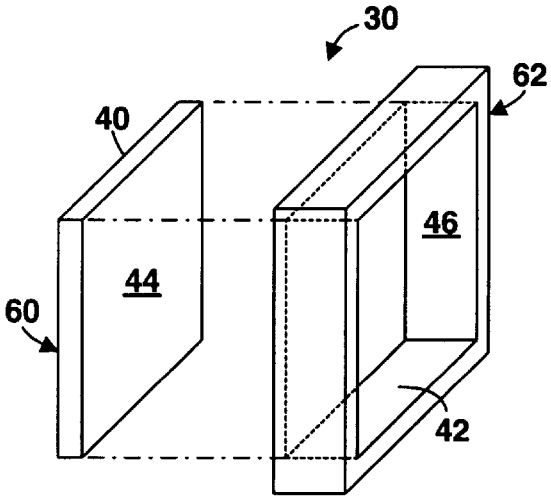
FIG. 7 is a perspective, exploded view of a second embodiment of the cup.
Figure 8:
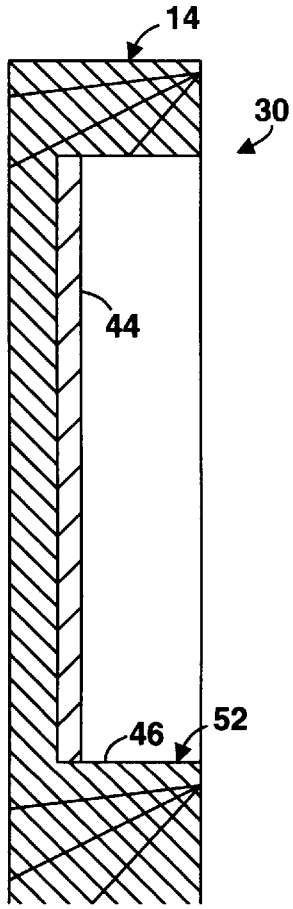
FIG. 8 is a side cross-sectional view of a third embodiment of the cup.

The cup 30 has one of three preferred embodiments. In the first embodiment, shown in FIG. 4, the cup 30 is a single piece of ferromagnetic material. The cup 30 may be formed by any number of methods, such as molding, casting, pressing, stamping, or folding. In the second embodiment, shown in FIG. 7, the cup 30 has two components, a base 60 that makes up the floor 44 and a ring 62 that makes up the walls 46. The components may be attached together to form the cup 30 prior to being attached to the screen frame 22, or they may be attached to the screen frame 22 separately, forming the cup 30 by means of their relative locations after being attached. In the second embodiment, it is only necessary that the base 60 be composed of a ferromagnetic material; the ring 62 does not have to be. The third embodiment, shown in FIG. 8, can only be used if the cup 30 is embedded in a recess 52, as described with reference to FIG. 3. The floor 44 is attached to the bottom of the recess 52 and the walls of the recess 52 function as the walls 46 of the cup 30.

Each magnet 32 is a typical permanent magnet with a flat surface by which it is attached to the window frame 18. The thickness of the magnet 32 is at least the depth of the depression 42 so that the flat operational surface 48 of the magnet 32 makes substantially full contact with the floor 44 of the depression 42 after the screen 14 is attached to the window frame 18. The magnets 32 are attached to the window frame 18 at places that are relatively smooth and substantially planar, smooth so that the attachment to the window frame 18 is relatively robust, and planar so that all of the magnets 32 reside completely in their respective cups 30. The means 36 by which the magnets 32 are attached to the window frame 18 includes an adhesive layer 64 on the magnets 32. The adhesive layer 64 may be applied to the magnets 32 by, for example, a double-sided adhesive tape or directly to the magnet 32. A release layer 66 protects the adhesive layer 64 prior to attachment to the window frame 18.

The preferred locations for the cups 30 are at the corners of the screen frame 22. If a more secure attachment is needed, it may be desired to locate additional cups 30 on the screen frame 22. In the event that the window 12 is round or oval, it is preferred that the cups 30 be spaced evenly around the screen frame 22 to provide for a maximally secure attachment for the number of cups 30 used.

The gasket 38 provides a barrier to prevent insects and other items from entering the window between the window frame 18 and screen frame 22. The gasket 38 is preferably a series of strips that are adhered to the screen frame 22 and extending between all of the adjacent pairs of cups 30. The gasket 38 is preferably composed of an easily compressible material, such as highly-compressible foam weather-strip, and is thicker than the gap 68 between the window frame 18 and screen frame 22 when the screen 14 is installed. This forces the gasket 38 to compress when the screen 14 is in place so that the gap is substantially filled.

OPERATION

The initial installation of the window screen attachment apparatus of the present invention starts by placing the magnets 32 in their respective cups 30. An optional step is to position the screen 14 on the window frame 18 to determine the locations where the magnets 32 will adhere, and then thoroughly clean those locations. The cleaning will provide a better surface for the magnets' adhesive layer 64. Then the release layer 66 is removed from the magnets 32, and the screen 14 is positioned and pressed against the window frame 18. The magnets' adhesive layer 64 adheres to the window frame 18, so that when the screen 14 is pulled away from the window 12, the magnets 32 remain adhered to the window frame 18. After installation, the locations of the magnets 32 will be a mirror image of the location of the cups 30.

The window screen 14 is easily reinstalled by positioning the cups 30 over the magnets 32 and letting the magnets 32 pull the cups 30 into contact. The cup walls 46 correctly align the screen 14 by providing a barrier to the lateral movement of the magnets 32 within the cups 30.

Thus it has been shown and described a window screen attachment apparatus which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. An apparatus for removably attaching a screen to a window having a window frame, said apparatus comprising:

(a) a screen having a rigid screen frame;

(b) a plurality of cups spaced around and permanently attached to said screen frame, each of said cups having a depression with a substantially flat floor and a substantially perpendicular wall, said floor being composed of a ferromagnetic material;

(c) a plurality of magnets, each of said magnets shaped to mate with one of said depressions and to fit relatively snuggly into said one of said depressions such that an operational surface of said magnet makes substantially full contact with said floor, each of said magnets including an adhesive layer opposite said operational surface and a release layer protecting said adhesive layer;

(d) said wall extending around enough of said floor to substantially prevent said magnet from moving laterally on said floor when said magnet is in said substantial full contact with said floor; and (e) a plurality of compressible gaskets permanently attached to said screen frame and extending between each adjacent pair of said cups;

(f) whereby said screen is attached to said window frame by placing said magnets into said cups, removing said release layers from said magnet adhesive layers, and pressing said adhesive layers against said window frame;

(g) whereby said screen is removed from said window frame by pulling said cups from said magnets; and (h) whereby said screen is reattached by aligning said cups with said magnets and allowing said magnets to pull said cups into contact with said magnets;

(i) said gaskets forming a barrier between said window frame and said screen frame when said screen is attached to said window frame.

2. The apparatus of claim 1 wherein said cup is formed from a single piece of ferromagnetic material.

3. The apparatus of claim 1 wherein said cup floor and cup wall are formed independently of each other.

4. The apparatus of claim 1 wherein said cup wall extends completely around said cup floor.

5. The apparatus of claim 1 wherein said cup is mounted to the surface of said screen frame.

6. The apparatus of claim 1 wherein said cup is mounted in a recess in the surface of said screen frame.

7. The apparatus of claim 1 wherein all of said depressions have substantially the same contour.

8. The apparatus of claim 1 wherein at least one of said depressions has a different contour from the remainder of said depressions.

9. A method for providing a window having a frame with a removable screen, said method comprising the steps of:

(a) providing a screen having a rigid screen frame, a plurality of cups spaced around and permanently attached to said screen frame, each of said cups having a depression with a substantially flat floor and a substantially perpendicular wall, said floor being composed of a ferromagnetic material, and a plurality of compressible gaskets permanently attached to said screen frame and extending between each adjacent pair of said cups;

(b) providing a plurality of magnets, each of said magnets shaped to mate with one of said depressions and to fit relatively snuggly into said one of said depressions such that an operational surface of said magnet makes substantially full contact with said floor, said wall extending around enough of said floor to substantially prevent said magnet from moving laterally on said floor when said magnet is in said substantial full contact with said floor, and each of said magnets including an adhesive layer opposite said operational surface and a release layer protecting said adhesive layer;

(c) placing said magnets into said mating cup depressions;

(d) removing said release layer from said magnets;

(e) pressing said magnet adhesive layers against said window frame to attach said screen to said window frame;

(f) pulling said screen frame so that said cups detach from said magnets in order to remove said screen from said window frame; and (g) aligning said cups with said magnets and allowing said magnets to pull said cups into contact with said magnets in order to reattach said screen to said window frame;

(h) said gaskets forming a barrier between said window frame and said screen frame when said screen is attached to said window frame.

10. The method of claim 9 wherein said cup is formed from a single piece of ferromagnetic material.

11. The method of claim 9 wherein said cup floor and cup wall are formed independently of each other.

12. The method of claim 9 wherein said cup wall extends completely around said cup floor.

13. The method of claim 9 wherein said cup is mounted to the surface of said screen frame.

14. The method of claim 9 wherein said cup is mounted in a recess in the surface of said screen frame.

15. The method of claim 9 wherein all of said depressions have substantially the same contour.

16. The method of claim 9 wherein at least one of said depressions has a different contour from the remainder of said depressions.

* * * * *